US010486283B2

(12) United States Patent
Lueng et al.

(10) Patent No.: US 10,486,283 B2
(45) Date of Patent: Nov. 26, 2019

(54) MANUFACTURING METHOD OF A SLIDER

(71) Applicant: SAE Magnetics (H.K.) Ltd., Hong Kong (CN)

(72) Inventors: Chiuming Lueng, Hong Kong (CN); Mankit Lee, Hong Kong (CN); Lorest Garcia Pingul, Hong Kong (CN); Yasutoshi Fujita, Hong Kong (CN); Cheukman Lui, Hong Kong (CN); Chiyuen Mok, Hong Kong (CN); Cheukwing Leung, Hong Kong (CN); Juren Ding, Hong Kong (CN); Rongkwang Ni, Hong Kong (CN)

(73) Assignee: SAE MAGNETICS (H.K.) LTD., Hong Kong (CN)

( * ) Notice: Subject to any disclaimer, the term of this patent is extended or adjusted under 35 U.S.C. 154(b) by 3 days.

(21) Appl. No.: 15/642,548

(22) Filed: Jul. 6, 2017

(65) Prior Publication Data

US 2017/0304987 A1 Oct. 26, 2017

Related U.S. Application Data

(63) Continuation of application No. 13/408,063, filed on Feb. 29, 2012, now abandoned.

(51) Int. Cl.

| | |
|---|---|
| ***G11B 5/127*** | (2006.01) |
| ***H04R 31/00*** | (2006.01) |
| ***B24B 37/04*** | (2012.01) |

(52) U.S. Cl.

CPC ..... *B24B 37/048* (2013.01); *Y10T 29/49048* (2015.01)

(58) Field of Classification Search

CPC ..... B24B 37/048

See application file for complete search history.

(56) References Cited

U.S. PATENT DOCUMENTS

| | | | | | |
|---|---|---|---|---|---|
| 4,007,560 | A * | 2/1977 | Janssen | B24B 37/08 | 451/262 |
| 4,098,032 | A | 7/1978 | Olbert | | |
| 5,713,123 | A | 2/1998 | Toyoda | | |
| 5,718,035 | A | 2/1998 | Yamanaka | | |
| 5,721,650 | A * | 2/1998 | Crane | G11B 5/4886 | 360/236.3 |
| 5,722,156 | A * | 3/1998 | Balfrey | B24B 37/00 | 125/12 |
| 5,923,500 | A | 7/1999 | Hagen | | |
| 6,081,991 | A * | 7/2000 | Tsunoda | G11B 5/6005 | 29/603.08 |

(Continued)

FOREIGN PATENT DOCUMENTS

JP 2000015576 A * 1/2000

*Primary Examiner* — Paul D Kim

(74) *Attorney, Agent, or Firm* — Nixon & Vanderhye PC

(57) ABSTRACT

A manufacturing method of a slider includes steps of: (a) providing a row bar with a plurality of slider elements connecting together; (b) lapping surfaces of the row bar so as to obtain a predetermined requirement; (c) lowering the temperature of the surfaces lapped in the step (b) before and/or during lapping; and (d) cutting the row bar into a plurality of sliders. The present invention can prevent a local high temperature generated on the magnetic head during lapping so that the performance of the magnetic head is improved.

9 Claims, 5 Drawing Sheets

(56) References Cited

U.S. PATENT DOCUMENTS 6,129,855 A * 10/2000 Sawada ..... G11B 5/6005 216/22
6,257,959 B1 7/2001 Kobayashi et al.
6,531,084 B1 3/2003 Strom et al.
6,627,909 B2 9/2003 Khlif
6,679,762 B2 1/2004 Fatula et al.
6,775,101 B2 8/2004 Satoh et al.
6,829,818 B2 12/2004 Kamigama et al.
6,831,249 B2 12/2004 Tam et al.
6,865,798 B2 3/2005 Fukuroi
6,913,515 B2 7/2005 Beaucage et al.
6,934,101 B2 8/2005 Fong et al.
6,942,544 B2 * 9/2005 Beaucage ..... B24B 37/042 451/41
6,960,117 B1 11/2005 Mahadev et al.
7,359,152 B2 * 4/2008 Matono ..... G11B 5/3166 360/125.33
7,464,456 B2 * 12/2008 Fujii ..... G11B 5/102 29/417
7,542,242 B2 6/2009 Shiraishi et al.
7,562,435 B2 7/2009 Mahadev et al.
7,656,617 B2 2/2010 Heng et al.
7,758,403 B2 * 7/2010 Chopra ..... B24B 37/044 451/103
8,024,748 B1 9/2011 Moravec et al.
8,427,790 B2 4/2013 Hirata et al.
8,588,040 B1 11/2013 Fujita et al.
8,984,738 B2 * 3/2015 Lueng ..... G11B 5/102 29/603.03
2002/0029461 A1 3/2002 Kamigama et al.
2002/0155794 A1 10/2002 Fatula et al.
2002/0170164 A1 11/2002 Fukuroi
2002/0179861 A1 12/2002 Khlif
2003/0053256 A1 3/2003 Satoh et al.
2004/0050831 A1 3/2004 Tam et al.
2004/0264020 A1 12/2004 Fong et al.
2005/0070208 A1 3/2005 Beaucage et al.
2005/0078416 A1 4/2005 Shiraishi et al.
2005/0245173 A1 11/2005 Mahadev et al.
2006/0215323 A1 9/2006 Mahadev et al.
2006/0232885 A1 10/2006 Heng et al.
2009/0052079 A1 2/2009 Iwasa
2009/0323222 A1 12/2009 Hirata et al.
2010/0000433 A1 1/2010 Gao et al.
2012/0234474 A1 9/2012 Li
2013/0219699 A1 8/2013 Lueng et al.

* cited by examiner

MANUFACTURING METHOD OF A SLIDER

RELATED APPLICATIONS

This is a continuation application of U.S. patent application Ser. No. 13/408,063, filed Feb. 29, 2012.

FIELD OF THE INVENTION

The present invention relates to information recording disk drive devices and, more particularly to a manufacturing method of a slider in the disk drive device and a manufacturing apparatus thereof.

BACKGROUND OF THE INVENTION

Hard disk drive incorporating rotating magnetic disks is commonly used for storing data in the magnetic media formed on the disk surfaces. Typically, magnetic heads embedded into sliders used in the hard disk drive are those having a structure in which a reproducing (read) head having a magnetoresistive element (that may be hereinafter called an MR element) for reading and a recording (write) head having an induction-type electromagnetic transducer for writing are stacked on a substrate.

For read heads, giant magnetoresistive (GMR) elements utilizing a giant magnetoresistive effect have been practically used as MR elements. Conventional GMR elements have a current-in-plane (CIP) structure in which a current used for detecting magnetic signals (that is hereinafter called a sense current) is fed in the direction parallel to the plane of each layer making up the GMR element. Another type of GMR elements have a current-perpendicular-to-plane (CPP) structure in which the sense current is fed in a direction intersecting the plane of each layer making up the GMR element, such as the direction perpendicular to the plane of each layer making up the GMR element. Another type of MR element is tunnel magnetoresistive (TMR) element, which also has a CPP structure and has become the mainstream MR element due to its more remarkable change of MR ratio by replacing GMR element.

FIG. 1 shows a detailed structure of a conventional CPP-TMR element read head, as shown, the read head 10 includes a first shielding layer 111 formed on a substrate 110, a second shielding layer 114, and a TMR element 112 sandwiched between the first and second shielding layers 111, 114, and a pair of hard magnets 113 formed on two sides of the TMR element 112. Concretely, the read head 10 may include antiferromagnetic (AFM) materials (not shown) within or near the TMR element 112. The TMR element 112 is a multiple-layer structure which includes a free layer (not shown) having a magnetization direction changed by an external magnetic field.

As known, the read head including the AFM materials, and/or the hard magnets 113, and/or the shielding layers 111, 114, and/or the free layer can be affected by temperature. For example, for the AFM materials, which have no magnetism due to their inner magnetic moment directions counteracting each other, however under a high temperature, the inner structure and the material characteristic of the AFM material may change and become unstable, the magnetic moment directions may change and be disordered for example. For the free layer, the high temperature will bring noises which also will affect the stability of the free layer, and in turn weaken the performance of the TMR element 112.

According to the conventional manufacturing method of sliders with the above-mentioned magnetic heads, typically, a wafer provided with many magnetic head elements is first cut to separate into a plurality of row bars each of which has a plurality of slider elements aligned. Then, each row bar is lapped so as to adjust its element height to a defined size. One important lapping surface is that the medium facing surface for each slider element which is called an air bearing surface (ABS). Concretely, the row bar is pressed to a rotating lapping plate at a predetermined pressure to lap the ABS of the row bar to a predetermined requirement. Finally, the row bar is cut into a plurality of individual sliders.

Inevitably, a local high temperature will be generated on the lapping surface during the lapping process. As mentioned above, the read head including AFM materials, and/or hard magnets 113, and/or shielding layers 111, 114, and/or free layer may be affected by temperature easily. And since the magnetic moment directions of the AFM materials or other elements are aligned either parallel or perpendicular to the ABS of the row bar, therefore when the local high temperature is generated on the ABS, the magnetic moment directions of the read head will be disordered, somehow like annealing effect without align magnetic direction, which will affect the performance of the magnetic head. On the other hand, high temperature noises may be generated on the free layer under the local high temperature, which cause the performance of the magnetic head unstable. As a result, unstable sliders such as with high temperature noise, hysteresis and bad characteristic curve with serious jumps may be produced. Finally, the function and performance of hard disk drives may be weakened.

Hence, it is desired to provide an improved manufacturing method of a slider and manufacturing apparatus thereof to overcome the above-mentioned drawbacks.

SUMMARY OF THE INVENTION

One objective of the present invention is to provide a manufacturing method of a slider, which can prevent a local high temperature generated on the magnetic head during lapping so that the performance of the magnetic head is improved, and in turn, an improved slider with good reading performance and high stability is obtained.

Another objective of the present invention is to provide a manufacturing apparatus of a slider, which can prevent a local high temperature generated on the magnetic head during lapping so that the performance of the magnetic head is improved, and in turn, an improved slider with good reading performance and high stability is obtained.

To achieve the above objectives, a manufacturing method of a slider of the present invention includes steps of: (a) providing a row bar with a plurality of slider elements connecting together; (b) lapping surfaces of the row bar so as to obtain a predetermined requirement; (c) lowering the temperature of the surfaces lapped in the step (b) before and/or during lapping; and (d) cutting the row bar into a plurality of sliders.

As one preferred embodiment, the step (c) includes refrigerating lapping medium applied on a lapping plate which is contacted the surfaces of the row bar.

Preferably, the lapping medium is abrasives which comprise lapping oil and/or diamond slurry.

As another preferred embodiment, the step (c) includes lowering the temperature of the row bar. Alternatively, the step (c) includes lowering the temperature of the lapping condition.

Preferably, the step (b) includes lapping an air bearing surface of the row bar and a back surface opposite the air bearing surface.

Preferably, the method further includes grinding a bottom surface of the row bar before the step (b), and lowering the temperature of the bottom surface before and/or during grinding.

As yet one embodiment, the method further includes lowering the temperature of a cutting surface before and/or during cutting the row bar.

Preferably, the temperature of the lapped surfaces is controlled in the range of 0° C.~15° C.

Accordingly, a manufacturing apparatus of a slider of the present invention includes a lapping machine for lapping surfaces of a row bar so as to obtain a predetermined requirement, a cooling device for lowering the temperature of the lapped surfaces before and/or during lapping, and a cutting machine for cutting the row bar into a plurality of individual sliders.

Preferably, the lapping machine comprises a fixture for clamping and controlling the row bar, a lapping plate for lapping the row bar, and a lapping medium supply device for supplying lapping medium on the lapping plate.

As one preferred embodiment, the cooling device is used for refrigerating the lapping medium or the lapping medium supply device.

Preferably, the lapping medium is abrasives which include lapping oil and/or diamond slurry.

Preferably, the lapping medium supply device comprises a ceramic ring for homogenizing the lapping medium on the lapping plate.

Preferably, the cooling device is further used for lowering the temperature of the row bar and/or lowering the temperature of the lapping condition.

As another preferred embodiment, the apparatus further includes a grinding machine for grinding a bottom surface of the row bar, wherein the cooling device is further used for lowering the temperature of the bottom surface before and/or during grinding.

In comparison with the prior art, the present invention lowers the temperature of the lapped surfaces before and/or during lapped, thus a local high temperature generated on the lapped surfaces may be cooled and dispersed, and the temperature of the lapped surface is in a range of 0° C.~15° C., therefore the magnetic moment directions or magnetization directions of the part of read head (including AFM layer, and/or hard magnet, and/or free layer, and/or shielding layers) may not disordered or affected by the local high temperature, which improved the stability of the read head. At the same time, little high temperature noises will be generated on the free layer of the read head, therefore the stability of the free layer is further improved, and in turn the reading performance of the magnetic head is improved. Furthermore, the yield of the slider is improved due to less poor sliders are produced.

Other aspects, features, and advantages of this invention will become apparent from the following detailed description when taken in conjunction with the accompanying drawings, which are a part of this disclosure and which illustrate, by way of example, principles of this invention.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
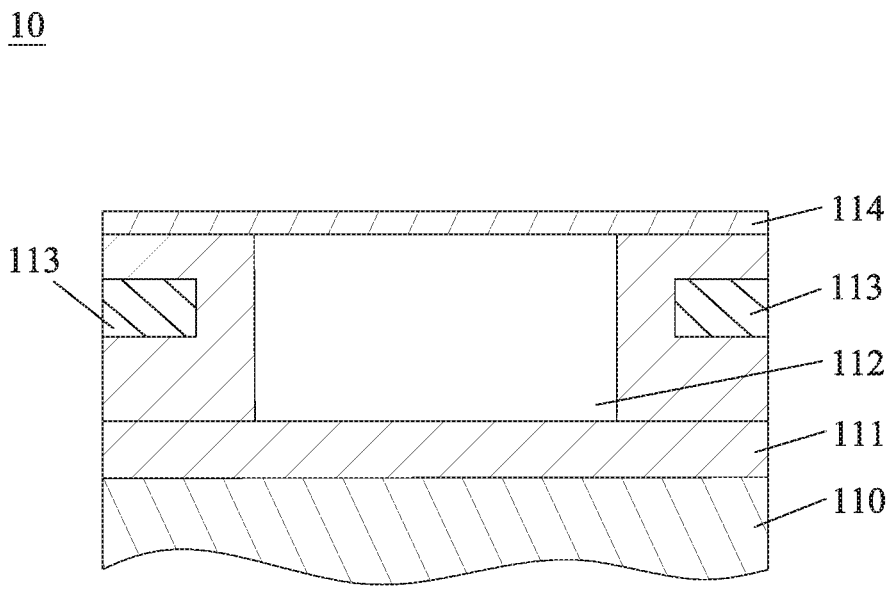
Fig. 1 (Prior art)
FIG. 1 is an ABS view of a conventional CPP-TMR element read head.

Various preferred embodiments of the invention will now be described with reference to the figures, wherein like reference numerals designate similar parts throughout the various views. As indicated above, the invention is directed to a manufacturing method of a slider, which can prevent a local high temperature generated on the magnetic head during lapping so that the performance of the magnetic head is improved.

The conventional magnetic head for a slider typically includes a read portion for reading data from the disk, and a write portion for writing data into the disk. The read portion is generally formed by a MR read head, specifically, the present description only concentrates on the CPP-TMR read head. Obviously, the persons ordinarily skilled in the art can understand the application of the present invention on the other read heads after reading the following descriptions.

Figure 2:
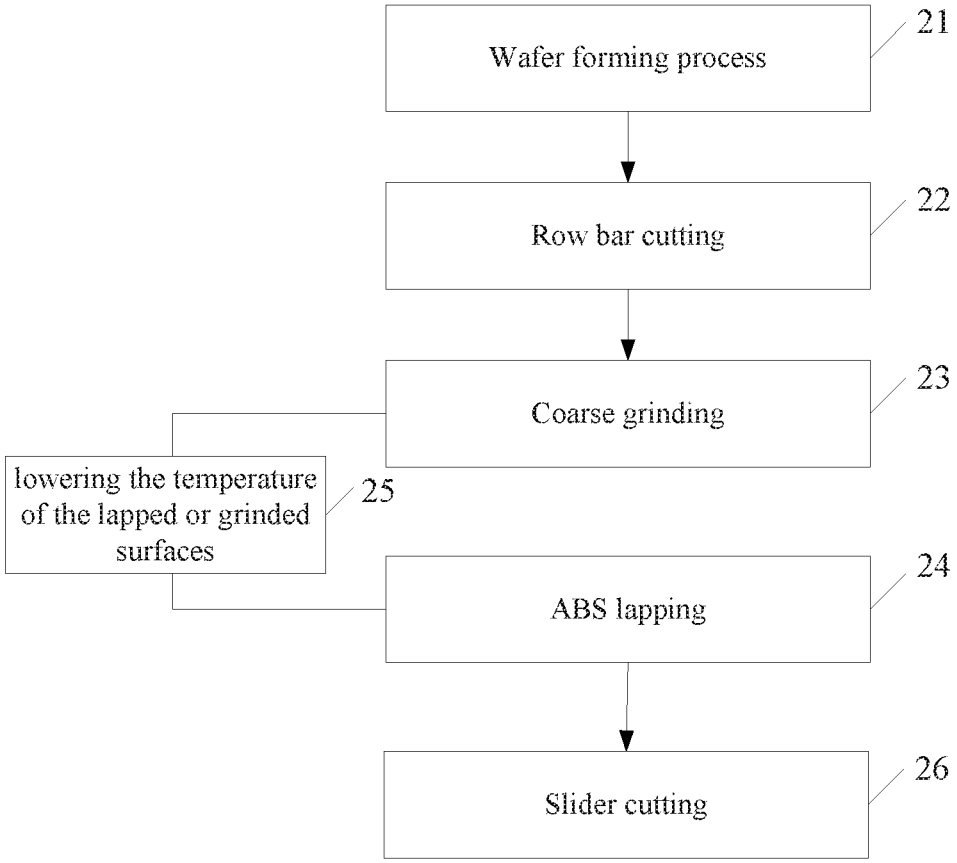
FIG. 2 schematically illustrates a manufacturing process of a slider according to one embodiment of the present invention.
Figure 3:
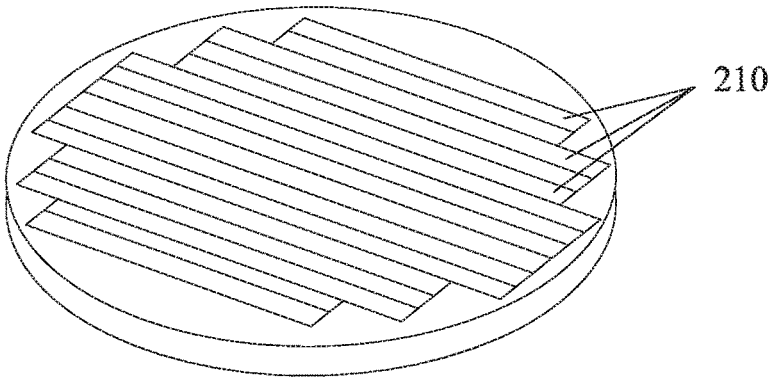
FIG. 3 illustrates a wafer provided in the manufacturing process shown in FIG. 2.
Figure 4:
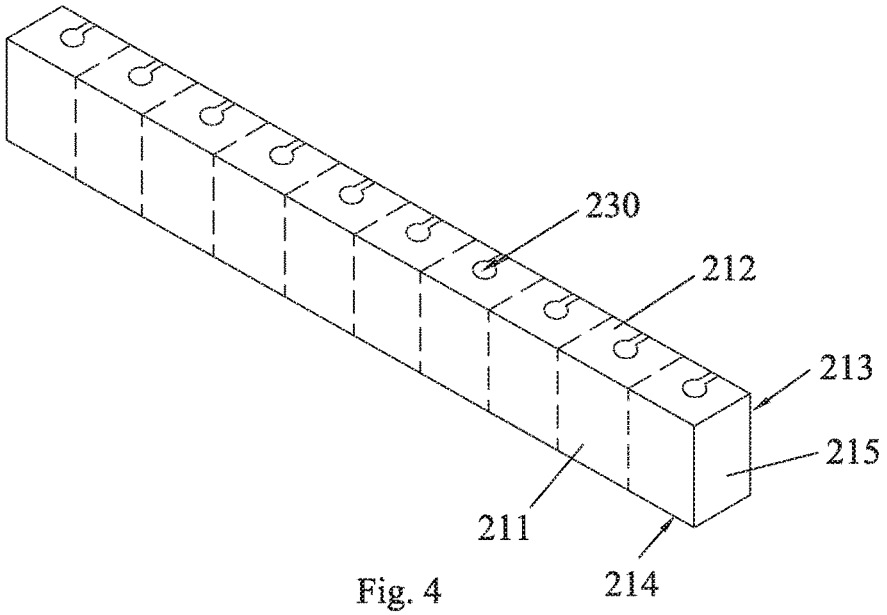
FIG. 4 illustrate a row bar cut down from the wafer shown in FIG. 3.

FIG. 2 schematically illustrates a manufacturing process of a slider according to one embodiment of the present invention, and FIG. 3 and FIG. 4 illustrate a wafer and a row bar made in the manufacturing process shown in FIG. 2, respectively. Hereinafter, the whole manufacturing process of the slider according to the present invention will be schematically described with reference to these figures.

At first, a wafer process is performed (step 21). In this wafer process, many slider elements with magnetic heads are formed by a thin-film technology on a wafer 20 made of a ceramic material. Each magnetic head is provided with a CPP-TMR read head and an inductive write head.

Then, a machining process is performed (step 22). In this process, first, the wafer 20 is cut into a plurality of blocks, and then each block is further cut to obtain a plurality of row bars 210. On each row bar 210, a plurality of slider 220 are aligned and arranged. As shown in FIG. 4, the row bar 210 has an ABS 211, a back surface 213 opposite the ABS 211, a bonding surface 212, a bottom surface 214 opposite the bonding surface 212, and two side surfaces 215. Each slider element 220 is provided with a magnetic head 230 embedded therein.

Then, a necessary and important machining step is performed which is lapping process (steps 23 and 24, at least). For increasing the lapping effect, a coarse grinding will be performed before the fine lapping, concretely, the bottom surface 214 of the row bar 210 is grinded to a predetermined size (step 23). Then, the ABS 211 of the row bar 210 is lapped to control characteristics of the magnetic head 230, for example magnetoresistive height (MR height) of the TMR element. Preferably, the back surface 213 of the row bar 210 can be lapped according to the actual demand. As an improvement of the present invention, it further includes step (25) of lowering the temperature of the surfaces of the row bar 210 before and/or during the surfaces are lapped or grinded.

This lapping process is performed using a conventional lapping machine including a lapping plate for lapping the row bar 210 and some lapping medium for helping the lapping, for example. The lapping medium may include lapping oil or diamond slurry and the like.

As one embodiment, the step (25) includes refrigerating the lapping medium which is applied on the lapping plate. Concretely, the lapping oil and/or the diamond slurry are refrigerated before they are supplied to the lapping plate and contacted with the row bar 210, and the lapping medium will be maintained under a lower temperature during lapping process. Preferably, the temperature controlled is in the range of 0° C.~15° C., such as 5° C.~10° C.

Based on the above design, a local high temperature generated on the lapped surfaces including the bottom surface 214, ABS 211 and back surface 213 will be cooled and dispersed by the cooling lapping medium contacted with these lapped surfaces. Thus, the magnetic moment directions or magnetization directions of the part of read head (including AFM layer, and/or hard magnet, and/or free layer, and/or shielding layers) may not disordered or affected by the local high temperature, which improved the stability of the read head. At the same time, little high temperature noises will be generated on the free layer of the read head, thereby the stability of the free layer is further improved, and in turn the reading performance of the magnetic head is improved. Furthermore, the yield of the slider is increased due to less poor sliders are produced.

As another embodiment, the step (25) may include lowering the temperature of the row bar 210 before and/or during the lapping process. As still another embodiment, the step (25) may include lowering the temperature of the lapping condition. Similarly, the options also can cool or alleviate the local high temperature generated on the lapped surfaces.

After the lapping process for the lapped surfaces, this row bar 210 is cut to separate into a plurality of individual sliders 220 (step 26). Preferably, during the cutting process, the temperature of the cutting surface is lowered so as to alleviate the local high temperature generated on the cutting surface which may disserve the performance of the read head.

Figure 5A:
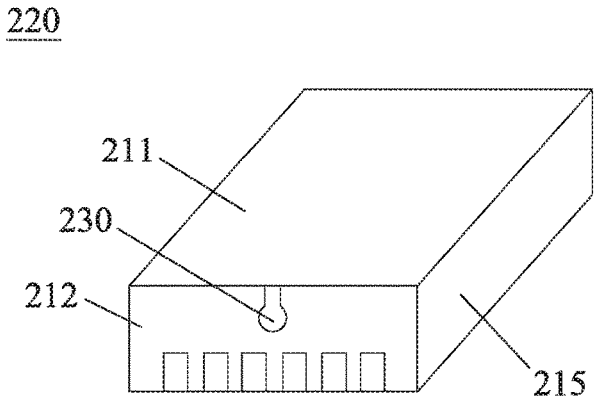
FIG. 5*a* shows an individual slider finally made by the manufacturing method according to the present invention.

FIG. 5*a* show an individual slider 220 with a magnetic head 230 finally made by the manufacturing method mentioned above, and FIG. 5*b* is a partial cross-section view of the magnetic head 230 of the slider 220, which illustrates the structure of a read head 300 of the magnetic head 230.

Figure 5B:
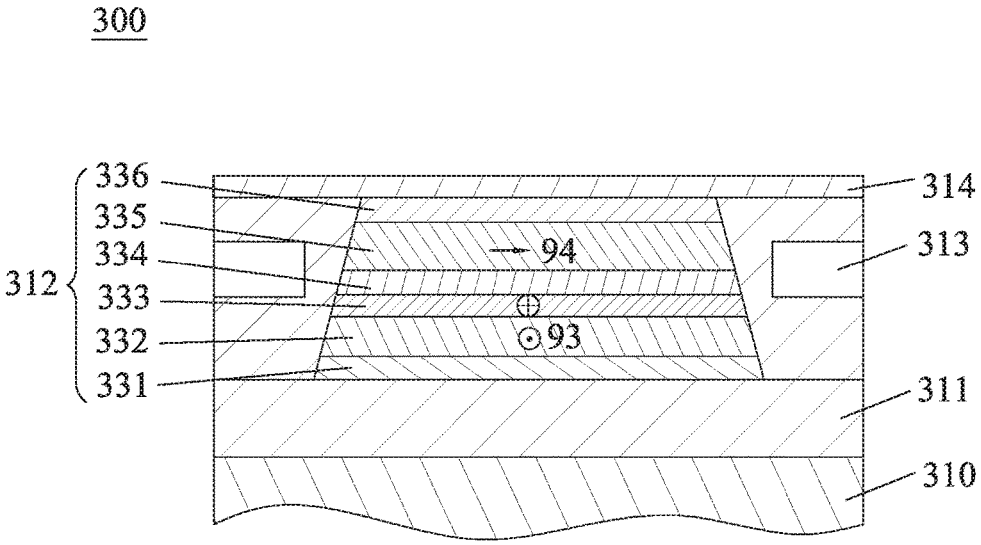
FIG. 5*b* is a partial cross-section view of the magnetic head of the slider shown in FIG. 5*a*, which illustrates the structure of a read head of the magnetic head.

As shown in FIG. 5*b*, the read head 300 includes a first shielding layer 311 formed on a substrate 310, a second shielding layer 314, and a TMR element 312 sandwiched between the first and second shielding layers 311, 314, and a pair of hard magnets 313 formed on two sides of the TMR element 312.

Concretely, the TMR element 312 is multiple-layer structure which includes a pinning layer 331, two pinned layers 332, 333, a tunnel barrier layer 334, a free layer 335, and a cap layer 336 stacked together in turn. The pinning layer 331 is formed on the first shielding layer 311, which is made of AFM material, such as NiO or IrMn. The pinned layer 332 has a series of magnetic moment directions 93 perpendicular to the ABS 211 and parallel to the bonding surface 212 of the slider 220. The free layer 335 contains a ferromagnetic substance and has a direction of magnetization 94 that changes in responds to an external magnetic field. The magnetization direction or the magnetic moment 94 of the free layer 335 orients generally parallel to the ABS 211 in the absence of an applied external magnetic field.

As mentioned above, when lapping the bottom surface 214, ABS 211 and the back surface 213, a local high temperature will be generated on the bottom surface 214, ABS 211 and the back surface 213 which will disorder the magnetic moment directions of the part of the read head 300 (AFM materials, and/or hard magnets 313, and/or free layer, and/or shielding layers 311, 314). Since the temperature of the lapped surfaces is cooled and dispersed by the means described above, thus the magnetic moment directions of the part of the read head 300 (including AFM layer, and/or hard magnet 313, and/or free layer 335, and/or shielding layers 311, 314) are not easy to change and disordered, at the same time, little high temperature noises will generate on the free layer 335 of the TMR element 312, which is beneficial to improve the stability of the read head 300.

Alternatively, an AFM layer (not shown) may be configured in the side surface 215 of the slider 220 and near the TMR element 312 so as to achieve a certain function (stabilizing the TMR element 312 for example), which has magnetic moment directions which are perpendicular to the bonding surface 212 and parallel to the ABS 211. Regarding to this type of slider, when cutting the row bar 210 along the side surface 215, a local high temperature also will be generated on the side surface 215 which will affect the magnetic moment directions of the second AFM layer arranged perpendicular to the bonding surface 212 and parallel to the ABS 211. Therefore, during the cutting process, because the temperature of the cutting surface is lowered, thus the magnetic moment directions of the AFM layer are maintained in the initial order without disorder, which is beneficial to maintain the stability of the read head 300 as well.

Figure 6:
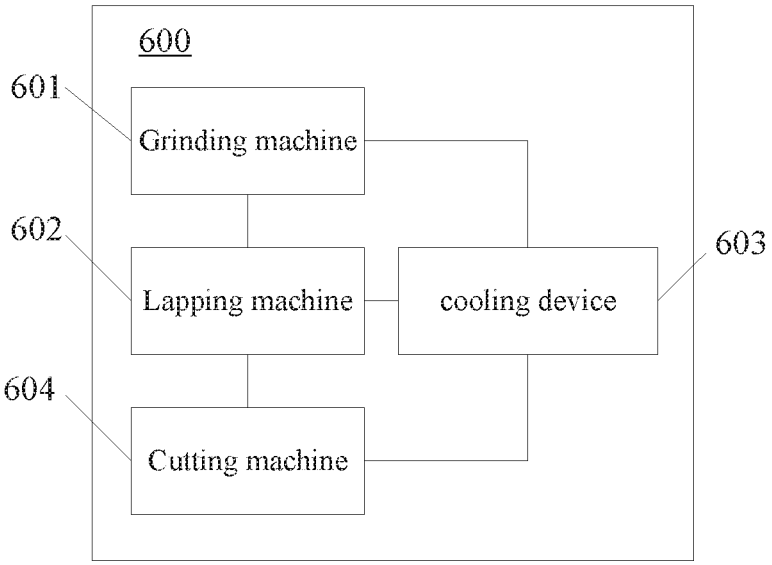
FIG. 6 is a schematic view of a manufacturing apparatus according to one embodiment of the present invention.

Accordingly, FIG. 6 shows a manufacturing apparatus used during the manufacturing method described above. The manufacturing apparatus 600 of a slider according to a preferred embodiment of the present invention includes a grinding machine 601, a lapping machine 602, a cooling device 603 and a cutting machine 604. Concretely, the grinding machine 601 is adapted for coarsely grinding the bottom surface 214 of the row bar 210 to a predetermined size. The lapping machine 602 is adapted for lapping the ABS 211 of the row bar 210 to control characteristics of the magnetic head 230, and lapping the back surface 213 of the row bar 210 optionally. The cooling device 603 is adapted for lowering the temperature of the lapped surfaces including the bottom surface 214, ABS 211 and back surface 213 before and/or during grinding and lapping.

Concretely, the lapping machine 602 includes a fixture (not shown) for clamping and controlling the row bar 210, a lapping plate (not shown) for lapping the row bar 210, and a lapping medium supply device (not shown) for supplying lapping medium on the lapping plate. The lapping medium is abrasives which include lapping oil and/or diamond slurry for example. Furthermore, the lapping medium supply device includes a ceramic ring for homogenizing the lapping medium on the lapping plate.

More concretely, the cooling device 603 is used for refrigerating the lapping medium and/or the lapping medium supply device. Optionally, the cooling device 603 is further used for lowering the temperature of the row bar 210, and/or lowering the temperature of the lapping condition, and/or lowering the temperature of cutting surfaces of the row bar 210 before and/or cutting the row bar 210.

Preferably, the temperature of the lapped surfaces controlled by the cooling device 603 in the range of 0° C.~15° C., such as 5° C.~10° C. in the present embodiment.

Based on the above design, a local high temperature generated on the lapped surfaces including the bottom surface 214, ABS 211 and back surface 213 will be cooled and dispersed by the cooling lapping medium contacted with these lapped surfaces or alleviated due to the cooled lapping condition and cooled row bar 210. Thus, the magnetic moment directions or magnetization directions of the part of read head (including AFM layer, and/or hard magnet, and/or free layer, and/or shielding layers) may not disordered or affected by the local high temperature, thereby improving the stability of the read head. At the same time, little high temperature noises will be generated on the free layer of the read head, thereby the stability of the free layer is further improved, and in turn the reading performance of the magnetic head is improved. As a result, stable sliders such as with little noise, little hysteresis and good characteristic curve with little jumps may be produced, finally the yield of the slider is increased due to less poor sliders are produced.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A manufacturing method of a slider, comprising:

(a) providing a row bar including a plurality of slider elements connecting together;

(b) lapping surfaces of the row bar so as to obtain one or more characteristics of the plurality of slider elements;

(c) lowering temperatures of the surfaces of the row bar lapped before and/or during the lapping of the surfaces, and controlling the temperatures of the surfaces to be between 0° C. and 15° C. during the lapping of the surfaces; and (d) cutting the row bar into a plurality of sliders.

2. The manufacturing method of a slider according to claim 1, wherein the temperatures of the surfaces of the row bar are controlled to be between 5° C. and ~15° C. during the lapping of the surfaces.

3. The manufacturing method of claim 1, wherein the surfaces of the row bar comprises an air bearing surface and a back surface opposite the air bearing surface.

4. The manufacturing method of claim 1, wherein lowering the temperatures of the surfaces of the row bar lapped before and/or during the lapping of the surfaces comprises refrigerating a lapping medium applied on a lapping plate contacting the surfaces of the row bar.

5. The manufacturing method of claim 4, wherein the lapping medium comprises lapping oil and/or a diamond slurry.

6. The manufacturing method of claim 1, wherein lowering the temperatures of the surfaces of the row bar lapped before and/or during the lapping of the surfaces comprises lowering the temperature of the entire row bar.

7. The manufacturing method of claim 1, wherein lowering the temperatures of the surfaces of the row bar lapped before and/or during the lapping of the surfaces comprises lowering the temperature of the lapping condition.

8. The manufacturing method of claim 1, further comprising lowering the temperature of a cutting surface before and/or during cutting the row bar.

9. The manufacturing method of claim 1, further comprising grinding a bottom surface of the row bar before the step (b), and lowering the temperature of the bottom surface before and/or during grinding.

* * * * *